United States Patent [19]

Götz

[11] 4,106,324

[45] Aug. 15, 1978

[54] FEEDING MECHANISM

[75] Inventor: Martin Götz, Sersheim, Germany

[73] Assignee: Erich Grau Stanzwerk fur Elektrobleche, Sersheim, Germany

[21] Appl. No.: 630,417

[22] Filed: Nov. 10, 1975

[30] Foreign Application Priority Data

Nov. 16, 1974 [DE] Fed. Rep. of Germany ..... 2454460

[51] Int. Cl.[2] ..... B21D 43/02; B26D 5/20; B65H 17/36

[52] U.S. Cl. ..... 72/421; 83/282; 226/147; 226/149; 226/151; 226/160

[58] Field of Search ..... 72/405, 419–421; 226/147, 149, 151, 158, 162, 127, 148, 160; 29/203 DS, 203 DT; 83/277, 278, 282, 129, 276

[56] References Cited

U.S. PATENT DOCUMENTS

| | | | |
|---|---|---|---|
| 560,839 | 5/1896 | Cohen | 83/129 |
| 1,207,068 | 12/1916 | Pagliarul | 226/160 |
| 1,931,760 | 10/1933 | Hermansdorfer | 83/278 X |
| 2,128,964 | 9/1938 | Pityo | 226/149 |
| 2,468,236 | 4/1949 | Rue | 226/149 X |
| 2,594,201 | 4/1952 | Nasmith et al. | 226/149 X |
| 2,944,458 | 7/1960 | Groll | 226/149 X |
| 3,076,367 | 2/1963 | Leibenger et al. | 83/277 X |
| 3,200,686 | 8/1965 | Norton et al. | 226/147 X |
| 3,361,316 | 1/1968 | Krause et al. | 226/149 |
| 3,836,060 | 9/1974 | Steinberger et al. | 226/151 X |

FOREIGN PATENT DOCUMENTS

| | | | |
|---|---|---|---|
| 800,068 | 6/1936 | France | 226/127 |
| 993,674 | 7/1951 | France | 226/127 |
| 429,053 | 5/1935 | United Kingdom | 226/160 |

*Primary Examiner*—C.W. Lanham
*Assistant Examiner*—D. M. Gurley

[57] ABSTRACT

The feeding mechanism serves to intermittently feed stock to a processing machine and comprises a rocker lever having at its outer end an arcuate surface shaped according to an arc of a circle, crank drive comprising a crank which is operatively connected to said rocker lever, said crank drive being operable to impart an oscillation to said rocker lever, a clamping roller adapted to cooperate with said arcuate surface and forming a feeding clamp therewith, a retaining clamp for holding said stock in position, and control means for cyclically opening and closing said feeding clamp and retaining clamp in alternation.

9 Claims, 3 Drawing Figures

FEEDING MECHANISM

This invention relates to a feeding mechanism for intermittently feeding stock to punching machines or presses.

Known feeding mechanisms for intermittently feeding stock to punching machines or presses comprise a retaining clamp for holding the stock in position and a reciprocating feeding clamp. These clamps are cyclically opened and closed in alternation. An input crank drive of the mechanism is driven from the eccentric shaft of the machine through a 1 : 1 bevel gear train. The feeding stroke can be adjusted by a change of the crank throw. Particularly in conjunction with high-speed machines it is difficult to ensure a satisfactory cooperation of the retaining and feeding clamps as they open and close.

It is an object of the invention to ensure even in conjunction with high-speed machines an exactly controlled cooperation of the retaining and feeding clamps and to achieve this by the use of simple means. In a feeding mechanism for intermittently feeding stock to punching machines or presses, comprising a retaining clamp for holding the stock in position and a reciprocating feeding clamp, which clamps are cyclically opened and closed in alternation, and which mechanism also comprises an input crank drive driven by a bevel gear train from the eccentric shaft of the machine, this object is accomplished in that the crank imparts an oscillation to a rocker lever, which has at its outer end an arcuate surface shaped according to an arc of a circle, and said surface cooperates with a clamping roller to form a feeding clamp. The clamping roller which cooperates with the rocker lever to form a feeding clamp is carried by one arm of a bell-crank lever and the other arm of the bell crank lever is spring-urged against a camwheel, which is parallel to the crank disc. The bell-crank lever is a double bell-crank lever having a third lever arm wich constitutes a clamping jaw, which cooperates with a second clamping jaw to form a retaining clamp and in such a manner that the retaining clamp is closed when the feeding clamp is open and vice versa.

This arrangement is highly economical and owing to the mechanical advantage afforded by the means for transmitting the spring forces involves small mass forces and a small load on the cam follower rollers so as to ensure a long life of all elements. The above-mentioned mechanical advantage will become apparent hereinafter.

To enable an adjustment of the clamps to the thickness of the stock, the double bell-crank lever may be pivotally mounted by means of an adjustable eccentric below the stock path and the lever arms carrying the clamping roller and the clamping jaw, respectively, may be disposed on opposite sides of said eccentric. The double bell-crank lever has a U-shaped long lever arm which extends around the crank drive and close to the camwheel and is adapted to be urged against the latter by a radially acting spring-loaded pin, preferably with a roller interposed.

Figure 1:
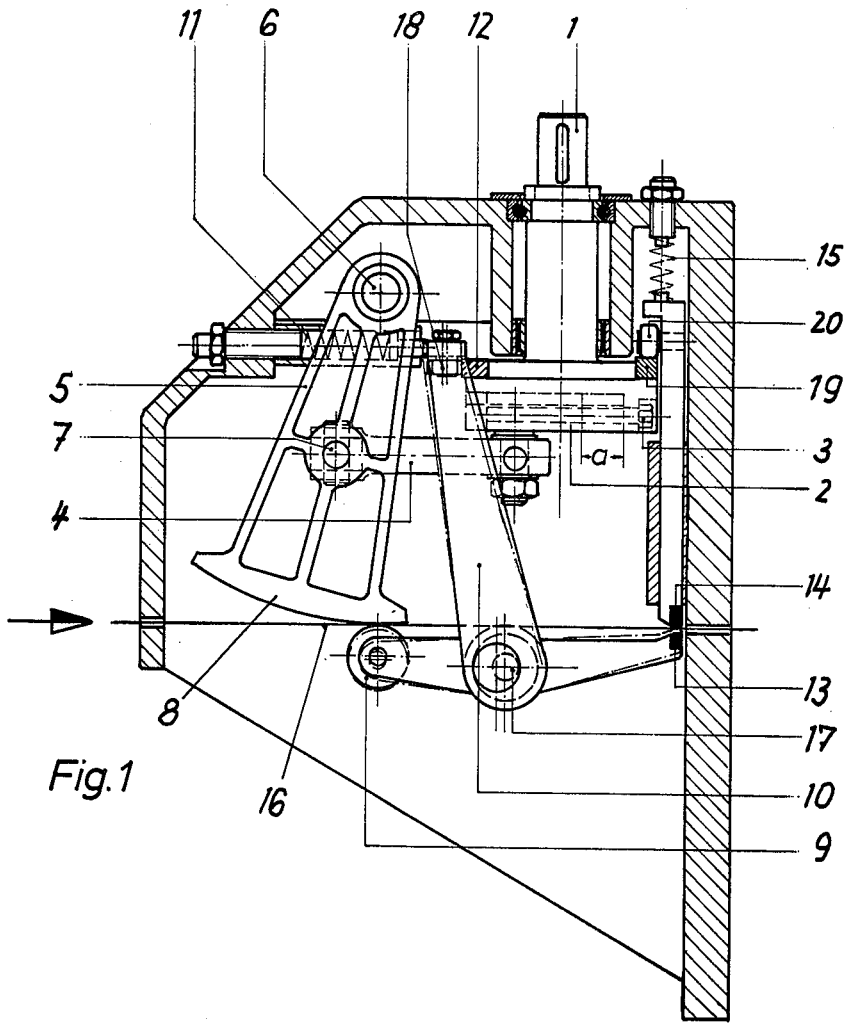
Figure 2:
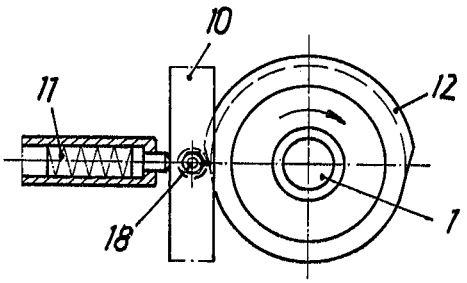
Figure 3:
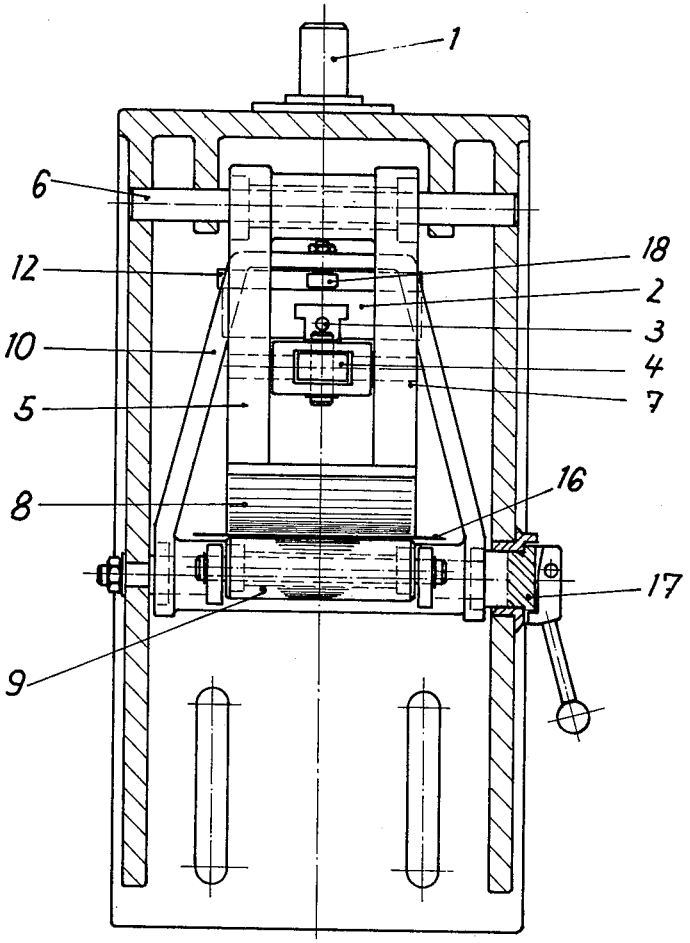

An embodiment of the feeding mechanism according to the invention is shown by way of example on the accompanying drawings, in which FIG. 1 is a longitudinal vertical sectional view diagrammatically showing the mechanism, FIG. 2 is a fragmentary view showing part of the mechanism of FIG. 1 in a top plan view, partly in horizontal section and FIG. 3 is a transverse vertical sectional view showing the mechanism.

The feeding mechanism is driven from the machine to be fed. Specifically, power is transmitted from the eccentric shaft of the punch or press through a 1:1 bevel gear train to a shaft 1, which at its end carries a crank disc 2 provided with a crank 4 and with means 3 for adjusting the throw of said crank. The latter and the rocker lever 5 are cyclically oscillated. The amplitude of the oscillation of the pendulum 5 depends on the adjusted throw of the crank. The rocker lever 5 is pivotally suspended at 6 and connected to the crank at 7.

The rocker lever comprises at its outer end an arcuate surface 8 which has the shape of an arc of a circle and which cooperates with a clamping roller 9 to form a feeding clamp 8, 9. The roller 9 is carried by a bell-crank lever 10, which is urged by a spring 11 against a camwheel 12, which is parallel to the crank disk 2.

The bell-crank lever 10 is a double bell-crank lever having a third lever arm 13, which constitutes a clamping jaw cooperating with a second clamping jaw 14, which is biased by a spring 15 and together with the clamping jaw 13 forms a retaining clamp 13, 14. This arrangement ensures that the movements are interlocked. The double-angle bell-crank lever 10 is pivotally mounted on both sides below stock path 16 by means of adjustable eccentrics 17, which enable a simple adjustment of the nip to the thickness of the stock to be fed along the path 16.

The double bell-crank lever 10 has a U-shaped long arm, which extends around the crank drive 2, 4 and close to the camwheel 12 and is urged by radially acting spring-loaded pins 11 against the camwheel 12, with the roller 18 interposed. The mechanical advantage afforded by the bell-crank lever connected to the feeding clamp results in a desirable contact pressure, which ensures that the stock will be carried along. On the other hand this spring bias need not be overcome in adjusting the clamp by means of the eccentrics 17 to the thickness of the stock.

The camwheel 12 carries another cam 19 for a temporary lifting of the second clamping jaw, which is biased by the spring 15 through the intermediary of the roller 20. This is apparent from the drawing.

What is claimed is:

1. The combination with a processing machine having an eccentric shaft, of a feeding mechanism for intermittently feeding stock to said machine, which feeding mechanism comprises a rocker lever having at its outer end an arcuate surface shaped according to an arc of a circle, a crank drive driven by the processing machine comprising a crank which is operatively connected to said rocker lever to impart oscillation thereto, a camwheel operatively connected to said crank, a clamping roller adapted to cooperate with said arcuate surface and forming a feeding clamp therewith, a retaining clamp for holding stock in position, a double bell-crank lever having a first, second and third arm, said first arm carrying said clamping roller, said third arm forming part of said retaining clamp, and said second arm connecting said first arm and said third arm and positioned for operative connection to said camwheel, a control means including said bell-crank lever, said camwheel and spring means for operatively urging said second arm of said bell-crank lever against said camwheel, said control means adapted to oscillate said bell-crank lever between a first position in which said feeding clamp is open and said retaining clamp is closed, to a second position in which said feeding clamp is closed and said retaining claim is open.

2. The combination set forth in claim 1, in which said machine is a punching machine.

3. The combination set forth in claim 1, in which said machine is a press.

4. A feeding mechanism for intermittently feeding stock to a processing machine, comprising a rocker lever having at its outer end an arcuate surface shaped according to an arc of a circle, crank driving including a crank operatively connected to said rocker lever to impart oscillation thereto a clamping roller adapted to cooperate with said arcuate surface and forming a feeding clamp therewith, a retaining clamp for holding the stock in position, a camwheel operatively connected to said crank a double bell-crank lever having a first, second and third arm, said first arm carrying said clamping roller, said third lever arm forming part of said retaining clamp and said second arm connecting said first arm and said third arm and positioned for operative connection to said camwheel and, a control means including said bell crank lever, said camwheel and spring means for operatively urging said second arm of said bell lever against said camwheel, said control means adapted to oscillate said bell-crank lever between a first position in which said feeding clamp is open and said retaining clamp is closed to a second position in which said feeding clamp is closed and said retaining clamp is open.

5. The mechanism of claim 4 in which the crank drive includes a crank disc.

6. A feeding mechanism as set forth in claim 4, in which said feeding clamp and retaining clamp define a stock path, said bell-crank lever is pivotally mounted on adjustable eccentric means disposed below said stock path, and said first and third lever arms extend on opposite sides of said eccentric means.

7. A feeding mechanism as set forth in claim 4, in which said second lever arm is U-shaped and longer than said first and third lever arms and extends around said crank drive and close to said camwheel, and said spring means comprise radially acting spring-loaded pin means urging said second lever arm against said camwheel.

8. A feeding mechanism as set forth in claim 4, in which said second lever arm carries a roller engaging said camwheel.

9. A feeding mechanism as set forth in claim 4, in which said retaining clamp comprises cooperating first and second clamping jaws, said second clamping jaw is spring-urged toward said first clamping jaw and said camwheel comprises first cam means engaging said second lever arm and second cam means engaging said second clamping jaw and operable to temporarily lift the same from said first clamping jaw.

* * * * *